United States Patent [19]

Arfelt et al.

[11] 4,040,652

[45] Aug. 9, 1977

[54] DOOR LOCK

[75] Inventors: Soren Christian Schoubye Arfelt, Ebberup; Ib Christian Clausen, Allested; Johannes Jensen, Odense; Knud Hansen Fynbo; Jean Arnold Fischer, both of Hjallese, all of Denmark

[73] Assignee: Daempa A/S, Knarreborg, Denmark

[21] Appl. No.: 441,602

[22] Filed: Feb. 11, 1974

Related U.S. Application Data

[63] Continuation of Ser. No. 340,583, March 12, 1973, abandoned.

[30] Foreign Application Priority Data

Mar. 20, 1972 Denmark ..... 1300/72

[51] Int. Cl.[2] ..... E05C 1/06

[52] U.S. Cl. ..... 292/167; 292/170; 292/DIG. 37

[58] Field of Search ..... 70/143, 432; 292/139, 292/158, 164, 165, 166, 167, 168, 170, 186, DIG. 37, DIG. 38

[56] References Cited

U.S. PATENT DOCUMENTS

| | | | |
|---|---|---|---|
| 408,552 | 8/1889 | Towne | 292/164 |
| 2,803,481 | 8/1957 | Williams et al. | 292/245 |
| 2,804,330 | 8/1957 | Ogley | 292/186 |
| 3,685,036 | 8/1972 | Torok | 340/274 |

FOREIGN PATENT DOCUMENTS

| | | | |
|---|---|---|---|
| 474,641 | 11/1937 | United Kingdom | 292/166 |
| 467,285 | 6/1937 | United Kingdom | 292/165 |

*Primary Examiner*—Richard E. Moore
*Attorney, Agent, or Firm*—Anthony A. O'Brien

[57] ABSTRACT

A door lock having a press button operable to retract the door bolt from its engaged to its released position, and a separate operating means to positively lock the bolt whereby the press button is raised or lowered from its normal position so as to serve as a visual signal indicating whether the bolt is locked or is free for normal retraction.

2 Claims, 19 Drawing Figures

Figure 2:
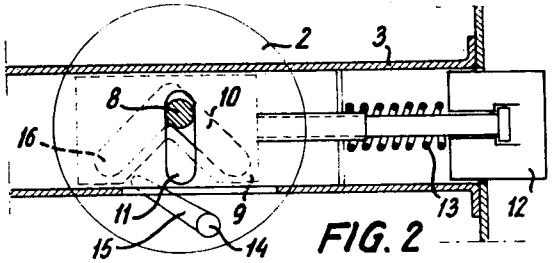

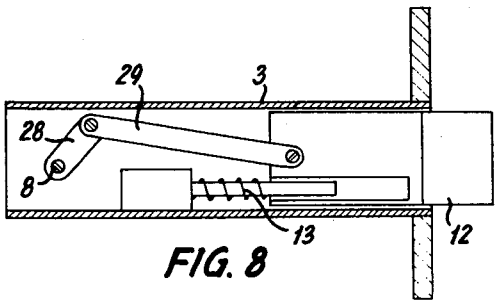
FIG. 8
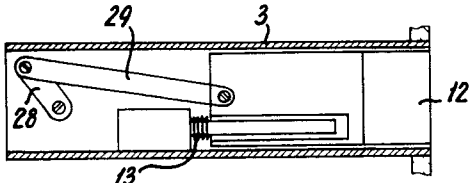
FIG. 9
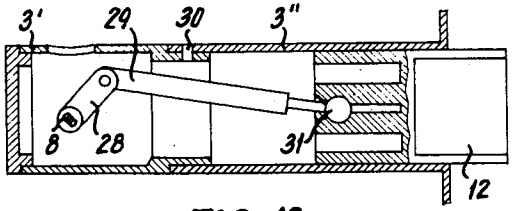
FIG. 10
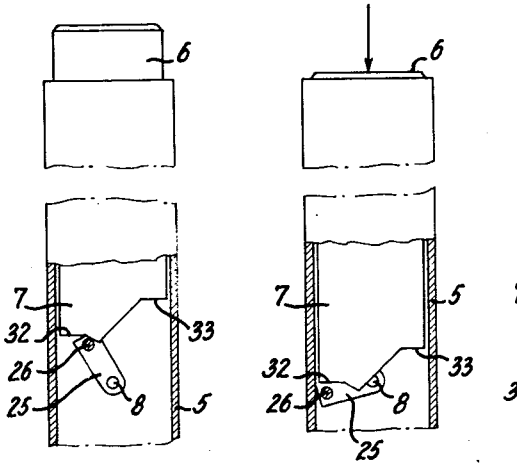
FIG. 11
FIG. 12
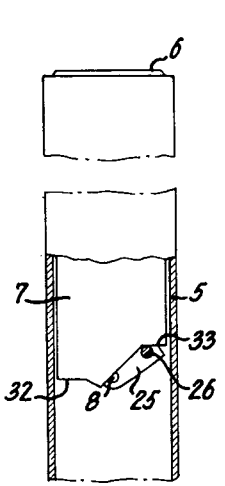
FIG. 13
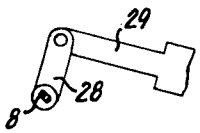
FIG. 14
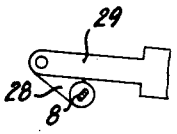
FIG. 15
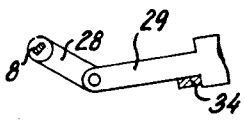
FIG. 16

DOOR LOCK

CROSS REFERENCE TO RELATED APPLICATION

This application is a continuation of pending prior application Ser. No. 340,583 filed Mar. 12, 1973 and now abandoned.

This invention relates to a door lock which, in a known manner, see, for example, U.S. Pat. No. 1,081,036, comprises a bolt that is spring-loaded against its normal (engaged) position, and a pair of door grips mounted on the opposite sides of the door and each including a vertically elongated housing that is secured to the door and spaced at least the thickness of a finger therefrom, and a press button that is mounted in or on the housing and by a pressure applied onto its free top side is downwardly displaceable in relation to the housing, the press button being operatively connected to the bolt via a crossbar extending through the door and possibly composed of several portions.

Such press-button-operated door locks are, from an ergonomic point of view, preferable to locks provided with a rotary knob and are, from an architectural point of view, regarded as being more attractive than door locks whose handle is horizontal in the normal position so as to break the generally vertical lines of the door.

In ordinary press-button-operated locks the bolt serves solely to keep the door closed and when the additional possibility of locking the door is desirable, a separate key-operated lock is employed which may possibly be incorporated in the housing of the press button door lock.

An object of the invention is to provide a press-button-operated door lock of the type defined in the foregoing and in which the bolt, besides keeping the door closed, also renders a positive locking possible. The arrangement shall also be such that a quick glance at the lock shall be sufficient to ascertain whether the bolt merely happens to be in its normal engaged position, and thus can be moved into its released position by means of the press button, or whether it is keeping the door locked and thus cannot immediately be displaced by the press button.

According to the invention, the bolt, with a view to locking the door, is also displaceable with the aid of a separate operating means and is connected with the press button in such a way that, by a movement of the bolt derived from the separate operating means, the press button is displaced out of its normal position in relation to the door grip housing.

Door locks with a bolt are known in which it is possible to block the bolt in its normal engaged position so as to prevent an unauthorized or undesired opening of the door. The blocking of the bolt has the effect that also the associated door grip, irrespective of whether it happens to be a press button, a rotary knob or a bar-shaped handle, is blocked in its normal position, that is to say, in the position assumed by the door grip when the door is closed without actually being locked, and only when attempting to open the door by operating the door grip, is it possible to ascertain whether the door is locked or not. Such an attempt at opening may damage the lock if such an attempt is effected with violence.

On the other hand, in the case of the door lock according to the invention the press button, due to its connection with the bolt, changes position in the door grip housing when the bolt is displaced with the aid of the separate operating means so as to be brought into its blocking or locking position. Thus, the press button is utilized as a visual signal to indicate, by its position, whether the door is locked or merely closed.

By way of example, the press button may be displaceable into its downwardly displaced position in relation to the door grip housing, corresponding to the released position of the bolt, by the displacement movement of the bolt derived from the separate operating means. The press button can hereby be displaced completely downwards into the door grip housing so that a further manual depression is practically excluded. Accordingly, the risk of the lock being damaged by violent actuation of the press button is eliminated or at least greatly reduced.

Figure 3:
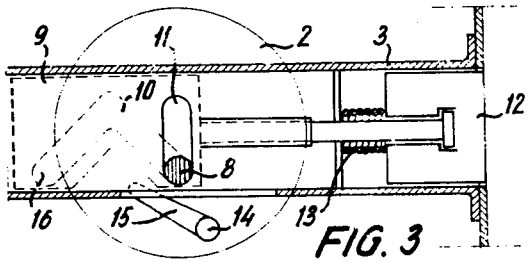
Figure 4:
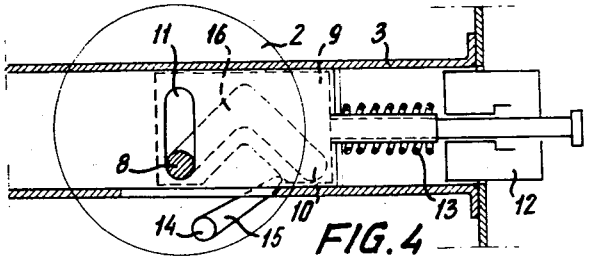
Figure 1:
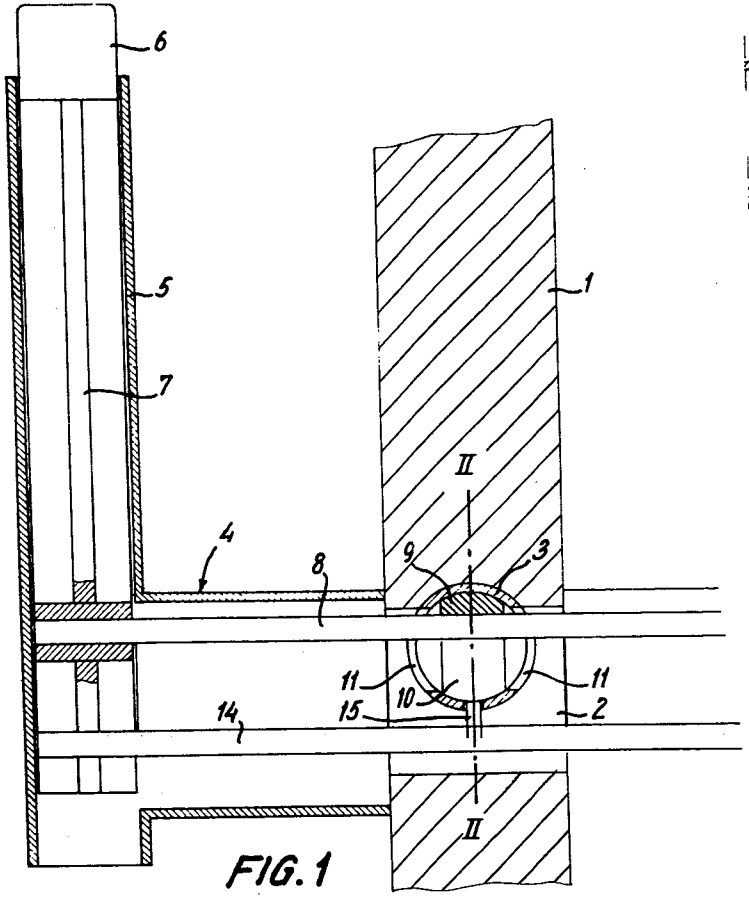
Figure 7:
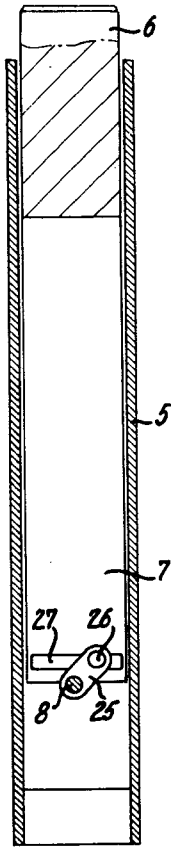
Figure 6:
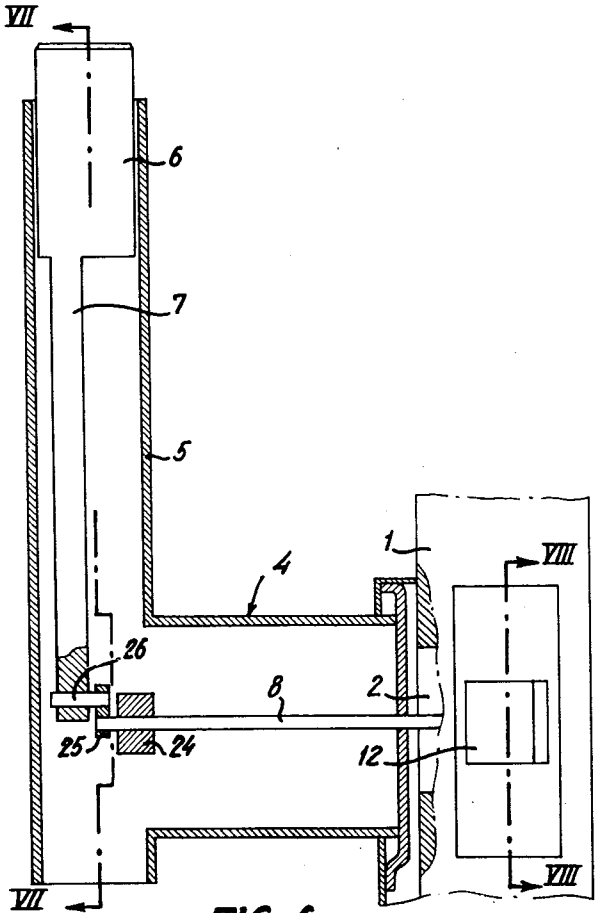
Figure 5:
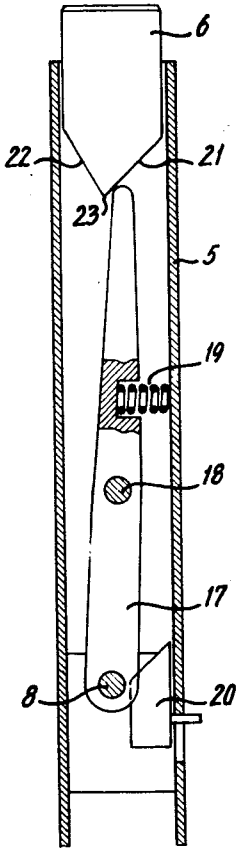
Figure 17:
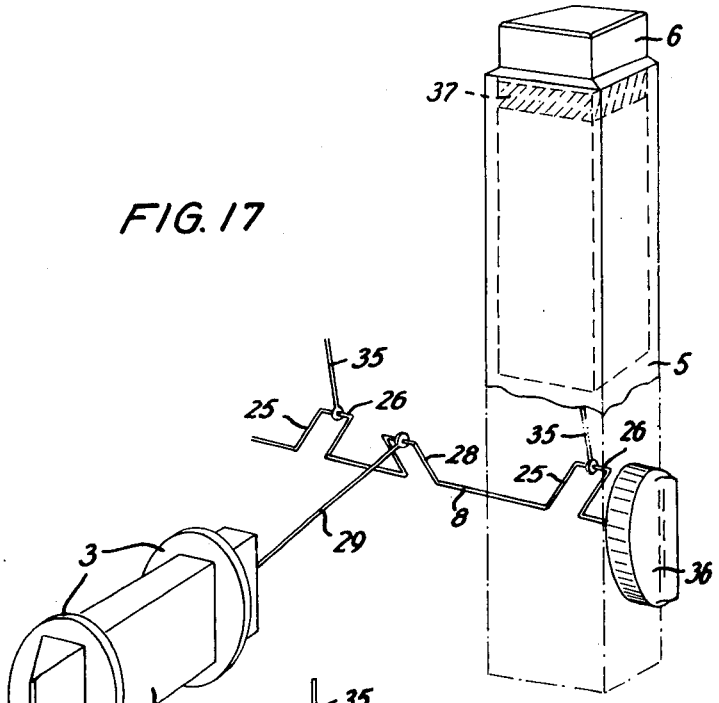
Figure 18:
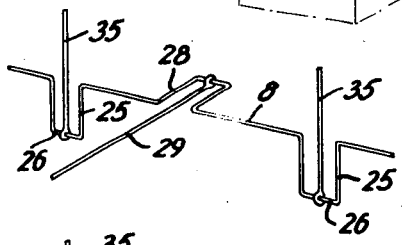
Figure 19:
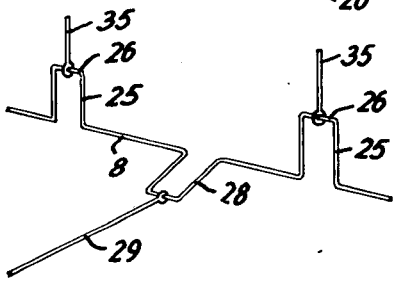

The invention will now be more fully described with reference to the accompanying substantially diagrammatical drawings, in which FIG. 1 shows a first embodiment of the door lock according to the invention depicted in a vertical section perpendicular to the door, FIG. 2 shows a vertical section taken along line II—II in FIG. 1 through the bolt mechanism of the door lock, FIG. 3 shows a similar section with the bolt in its withdrawn or released position, FIG. 4 shows a similar section with the bolt in its locking position, FIG. 5 shows a section parallel to the door (not shown) through the door grip forming part of another embodiment of the door lock according to the invention, FIG. 6 shows a view similar to FIG. 1 of the door lock in a third embodiment, FIG. 7 shows a vertical section taken along line VII—VII in FIG. 6, FIG. 8 shows a vertical section taken along line VIII—VIII in FIG. 6 through the bolt mechanism of the door lock and with the bolt in its normal or engaged position, FIG. 9 shows a similar view with the bolt in its withdrawn or released position, FIG. 10 shows a view similar to FIG. 8 of the bolt mechanism in a modified embodiment, FIGS. 11 to 13 show component parts of the door grip forming part of yet another embodiment of the door lock according to the invention depicted in the normal, in the opening and in the locking position, respectively, FIGS. 14, 15 and 16 show a connecting rod mechanism serving to move the bolt, depicted in the same three positions, FIG. 17 shows a schematical perspective view of a further embodiment of the door lock according to the invention, and FIGS. 18 and 19 show the crossbar or crankshaft of the door lock in the released and in the locking position of the bolt, respectively.

FIG. 1 shows part of a door 1 with a transverse hole 2 and a bore terminating in the edge of the door and intended to accommodate a casing 3. On each side of the door, in a manner not shown in greater detail, a door grip housing 4 is secured which includes a vertical, tubular portion 5 that houses a displaceable press button 6 which, in its normal position, as shown in FIG. 1, extends a distance above tube 5. Press button 6 is, via a vertical plate or rod 7, rigidly connected to a crossbar 8 that extends through the hole in the door 2 and through the casing 3. A bolt follower 9 is displaceably accomodated in the casing 3 and comprises an inclined slot 10 for the passage of crossbar 8. By depressing press button 6 the bar 8 is displaced vertically downwards through a pair of guide tracks 11 in bolt casing 3 and, by engaging with the inclined slot 10, it forces the follower 9 towards the left from the position shown in FIG. 2. Consequently bolt 12, which is urged in the opposite direction by a spring 13, is displaced from the position shown in FIG. 2 into the position shown in FIG. 3, in which the bolt is disengaged from the associated striking plate, now shown. When press button 6 is released, bolt 12 once more jumps forward into its normal position shown in FIG. 2, whereby crossbar 8 and press button 6 return to the starting position.

From the normal or engaged position, see FIG. 2, bolt 12 or its follower 9 can be further displaced forwardly into a positive locking position by the rotation of a lock shaft 14 with a pawl 15 for direct engagement with follower 9. The follower is provided with an additional inclined slot 16 which, in this situation, forces crossbar 8 and, thereby, press button 6 downwardly, so that the press button will become hidden inside tube 5 as long as the door remains locked (and not merely closed). The turning of lock shaft 14 can be effected by means of a separate grip (not shown). Such a grip on the one side of the door, e.g. the outside when an outer door is involved, can be adapted to key operation.

In the embodiment shown in FIG. 5, crossbar 8, instead of being vertically displaceable as in FIGS. 1 to 4, is horizontally displaceable to cause, directly or indirectly, a corresponding displacement of the bolt, not shown. According to FIG. 5, crossbar 8 is supported by the lower end of a lever 17 which, on a hinge pin 18, is pivotably journalled in the door grip tube or in door grip housing 5 and is urged by a spring 19 against its normal position shown in the drawing in which crossbar 8 or lever 17 abuts against a vertically displaceable stop 20.

The underside of press button 6 comprises two inclined faces 21 and 22 which converge into an edge 23 and which interact with the upper end of lever 17. In the normal position shown the lever contacts the inclined face 21 and , by depressing press button 6, the lever will consequently be forced into clockwise rotation whereby crossbar 8 is displaced to the left. The bolt, not shown, is hereby withdrawn from its normal position into its released position.

If the door is to be locked, stop 20 is drawn downwards so that it gets out of the path of movement of cross-bar 8 and lever 17, whereby spring 19 forces lever 17 to turn anti-clockwise. The upper end of the lever then passes edge 23 on press button 6 which consequently slides downwards into its lower, hidden position inside tube 5. When the door is unlocked by moving stop 20 backwards, the upper end of lever 17 will, due to its abutment against inclined face 22, once again force press button 6 upwards into its normal position.

In this embodiment according to FIGS. 6 to 10, crossbar 8 is rotatable around its longitudinal axis and rests in a pair of bearings 24 in the two door grip housings 4. The crossbar carries a crank arm 25 with a crank 26 that engages with a horizontal slot 27 in the plate 7 which is integral with press button 6. The connection of crossbar 8 with bolt 12 also comprises a crank mechanism having a crank arm 28, see FIGS. 8 and 9, and a connecting rod 29.

In the normal or engaged position of the bolt, see FIGS. 6, 7 and 8, crank arm 28 is inclined upwards to the right and, by depressing press button 6, it is rotated anticlockwise into the position depicted in FIG. 9, whereby bolt 12 is withdrawn against the action of spring 13.

If the door shall be locked, crossbar 8 is rotated clockwise from the position shown in FIG. 8 with the aid of an outer operating means, not shown, whereby connecting rod 29 passes its horizontal dead centre position while, at the same time, crank 26 travels across into the left-hand end of slot 27 and, in so doing, draws press button 6 downwards into its hidden position inside door grip tube 5.

FIG. 10 shows a particular embodiment of the bolt mechanism comprising a bolt casing that is composed of a stationary portion 3′ and a portion 3″ that is rotatable around its longitudinal axis and is connected with the stationary portion 3′ via a radial pin 30 extending into a peripheral slot, not invisible in the drawing. Bolt 12 is displaceably, but non-rotatably accomodated in casing portion 3″ and presents a seat for a ball head 31 on connecting rod 29. By this construction it is intended that it should be possible for the same door lock to be utilized for both right-handed and left-handed doors without any modification except rotating the bolt casing portion 3″ and bolt 12 through an angle of 180° in relation to the stationary portion 3′ of the bolt casing.

FIGS. 11 to 13 show another embodiment of the motion-transmitting connection from press button 6 to crossbar 8. In this case the lower edge of the press button plate 7 is designed as a cam surface with a first ledge 32 which interacts with crank 26 of crossbar 8 when the lock is moved between its normal position of FIG. 11 and its released or retracted position of FIG. 12, and a higher-located ledge 33 that rests against crank 26 in the locking position of FIG. 13, and is so positioned that press button 6, in this position, lies hidden inside door grip tube 5.

FIGS. 14 to 16 show the corresponding positions of the crank mechanism for moving the bolt, and FIG. 16 in particular shows that a stop 34 may be fitted in the bolt casing for preventing a backward displacement of the bolt from its locked position.

In the embodiments described in the foregoing, press button 6 disappears, so to speak, down into the tubular portion 5 of the door grip when bolt 12, with the aid of the separate operating means 14, 15 (FIGS. 1 to 4) or 20 (FIG. 5), is moved into its advanced locking position. In this way the press button indicates visually that the door is locked. A corresponding visual signal can be obtained by the press button being displaced upwardly from its normal position inside the door grip housing when the separate operating means is actuated.

FIGS. 17 to 19 show the relevant components of a door lock with this indicating function. For elements that are analogous to the aforementioned embodiments, the same reference numerals are used.

According to FIGS. 17 to 19, crossbar 8, which passes through the door, not shown, forms a crankshaft with two equiangularly positioned crank throws 25, 26 which, via connecting rods 35, are connected to their associated press buttons 6 in the door grip housings 5 secured to the inside and outside, respectively, of the door. Only the inside door grip housing is shown. A central crank throw 28 that is located at approximately right angles to the other two crank throws 25, 26 is, via connecting rod 29, connected to bolt 12 in bolt casing 3.

It is immediately apparent that bolt 12 is retracted from its normal position shown in FIG. 17 to its released position by a downwardly directed movement of press button 6 causing the crank shaft to be rotated about 135° into the position dipicted in FIG. 18. A spring (not shown) returns the component parts into the starting position when press button 6 is released.

A separate operating means in the form of a rotary knob 36 is secured on the innermost extremity of crankshaft 8 and renders possible an oppositely directed rotation of same, that is to say, into the position shown in FIG. 19. In this position the bolt has been pushed further forward into its locking position in which its crank throw 28 has just passed its horizontal, forwardly facing position while the other two crank throws 25, 26 point vertically upwards, whereby they have displaced the associated press buttons 6 a distance upwards into door grips 5 from the normal position shown in FIG. 17. By this displacement, an indicator area 37 which normally lies hidden inside tube 5, becomes visible above its top edge of the grip and thereby indicates that the door is locked.

The other extremity of crankshaft 8, too, can be connected to a separate operating means that should be associated to a key lock.

As appears from the description of a number of embodiments of the invention it will be possible to carry this into effect in numerous ways while employing components and elements that are known per se, including also such components and elements which are not shown in the drawings. Moreover, it appears that both the individual elements and their connections can be of a sturdy nature which will render the door lock to all intents and purposes operationally dependable under all conditions even when subjected to rough handling. Finally, for the sake of completeness, it should be mentioned that the crossbar 8 may possibly be composed of two or more portions which, in a suitable manner, are detachably coupled together inside the lock.

What is claimed is:

1. A lock for a door or the like, comprising in combination a tubular casing, a bolt slidably disposed in said casing along a longitudinal axis thereof, said bolt being movable between a plurality of positions including a latched position, a locked position and a released position, actuator means carried by said casing, an operative connection between said actuator means and said bolt for transmitting movement therebetween in response to movement of the actuator means, said operative connection including a crank element and a connecting rod articulated to said crank element and connected to said bolt by a universal joint, the arrangement being such that in the locked and the released positions, respectively, of said bolt, the point of articulation between said crank element and said connecting rod is spaced from and located on one and the other side, respectively, of a plane perpendicular to the direction of movement of said bolt and containing the axis of said crank, while in the latched position of said bolt the spacing of said point of articulation from said plane is smaller than such spacing in said locked position, means biasing said bolt toward its latched and locked positions, and said casing including a first part which contains said actuator means and said crank and a second part which contains said bolt, said first and second parts being rotatable approximately 180° in relation to each other around the longitudinal axis of the casing, whereby the lock may be subject to left and right hand installation.

2. A lock as claimed in claim 1 wherein a stop is disposed in said casing and cooperates with said connecting rod to prevent displacement of said bolt from its locked position.

* * * * *